United States Patent [19]

Ernst

[11] 3,965,510

[45] June 29, 1976

[54] COMBINATION DRILLING AND WRENCHING TOOL

[75] Inventor: Richard John Ernst, Palatine, Ill.

[73] Assignee: Illinois Tool Works Inc., Chicago, Ill.

[22] Filed: Sept. 15, 1975

[21] Appl. No.: 613,136

Related U.S. Application Data

[63] Continuation-in-part of Ser. No. 575,922, May 9, 1975, abandoned.

[52] U.S. Cl. .....7/14.1 R; 81/52.4 R

[51] Int. Cl.[2] ..... B25F 3/00

[58] Field of Search ..... 7/1 G, 1 R, 14.1 R; 145/50 B, 61 R; 81/52.4 R, 119, 121 R

[56] References Cited

UNITED STATES PATENTS

| | | | |
|---|---|---|---|
| 2,489,648 | 11/1949 | Koffler | 81/121 R |
| 3,177,910 | 4/1965 | Da Silva | 145/61 R |
| 3,336,611 | 8/1967 | Schepp | 7/1 R |
| 3,452,373 | 7/1969 | Vosbikian et al. | 7/1 R |

*Primary Examiner*—Al Lawrence Smith
*Assistant Examiner*—Roscoe V. Parker
*Attorney, Agent, or Firm*—T. W. Buckman; R. E. Beart

[57] ABSTRACT

A combination tool attachment for a power tool device, including a mandrel carrying a drill bit, telescopically mounted in a body portion. The body portion including a socket-type driving extremity with a bore extending therethrough so that the drill can selectively be retracted or extended. A rotatable plastic sleeve is mounted around the body allowing an operator to safely hold the tool. An axial recess extending outwardly from the socket enables the threaded fastener associated therewith to be seated without overdriving.

20 Claims, 14 Drawing Figures

COMBINATION DRILLING AND WRENCHING TOOL

This application is a continuation-in-part of Ser. No. 575,922 filed May 9, 1975, now abandoned.

This invention relates generally to combination tools and more particularly to tools which may be selectively utilized as either a drill or a wrenching member.

There are a number of fastening applications requiring that a workman first drill a hole in a workpiece and subsequently drive a threaded fastener into the hole. For repetitious applications such as these, the use of a single tool to both drill the hole and drive the fastener can result in a significant savings in time and reduction in application costs.

It is, accordingly, a principle object of the invention to provide a tool capable of drilling a hole in a workpiece and then being quickly and simply manipulated to drive a threaded fastener in the hole.

A further object of the invention is to provide a combination tool with a wrenching socket capable of seating a fastener without overtorquing.

A still further object of the invention is to provide a combination tool which can be safely and readily held by a workman during the operation thereof.

The principle features of the invention leading to the fulfillment of the above objects are; a drill bit holding mandrel which is mounted in an outer body portion for selective, relative, limited telescopic movement therein. The outer body member includes a through bore and one end is formed as a wrenching socket, which in the preferred embodiment, also includes a short recess extending axially outwardly from the socket. A sleeve portion is rotatably mounted about the body so that a workman can hold the combination tool while it is rotating.

DESCRIPTION OF THE PREFERRED EMBODIMENT

Figures 1, 2, 3, 4, 5, 6, 7, 8, 9, 10:
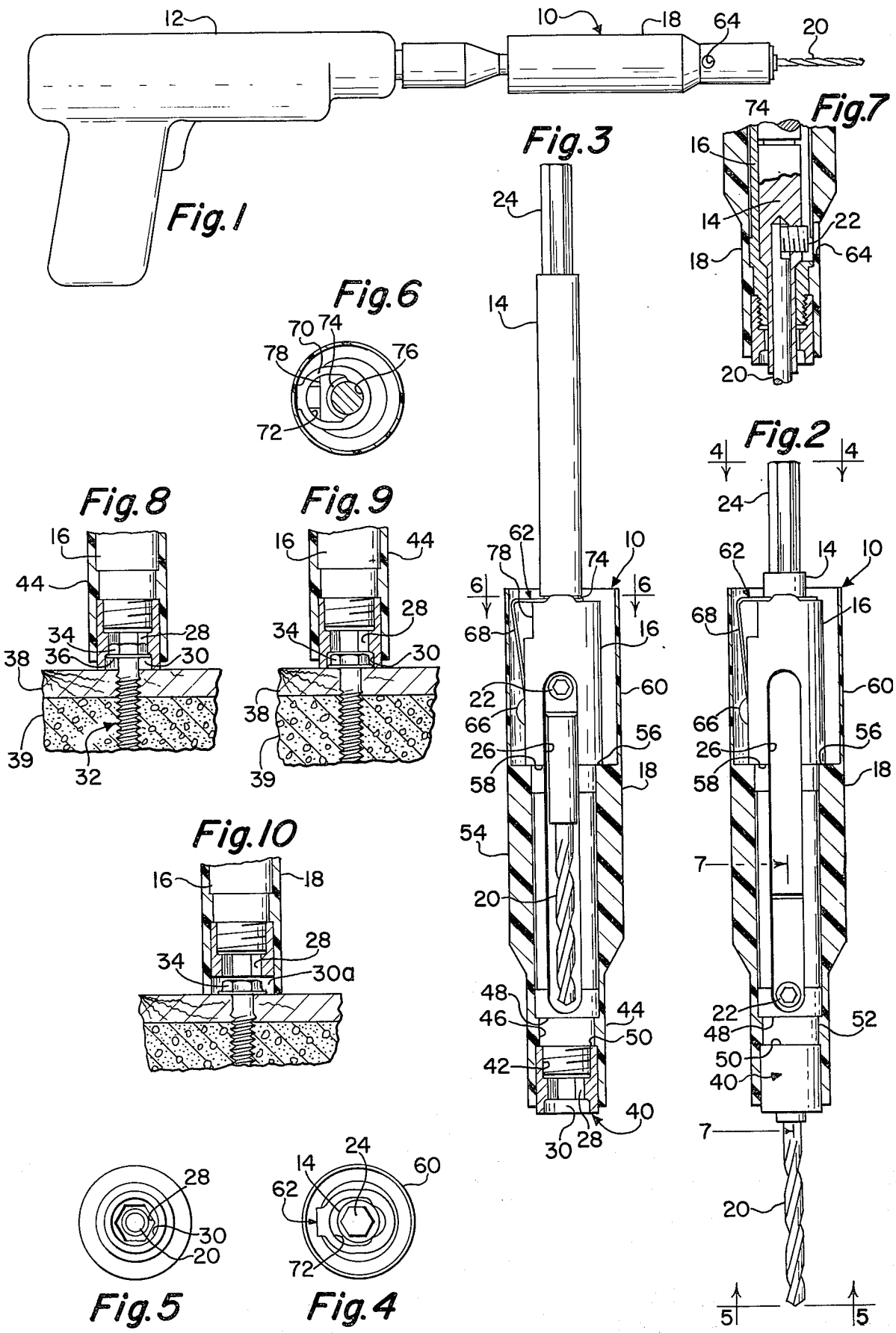
FIG. 1 is a side elevational view of the combination tool mounted on an appropriate power tool device.
FIG. 2 is a longitudinal, partial sectional view of the combination tool with the mandrel extended for use as a drill.
FIG. 3 is a longitudinal, partial sectional view of the combination tool with the mandrel retracted so that the tool may be used as a socket wrench device.
FIG. 4 is an end view of the combination tool in the direction of the line 4—4 of FIG. 2.
FIG. 5 is an end view of the combination tool in the direction of line 5—5 of FIG. 2.
FIG. 6 is a transverse sectional view of the tool taken in the direction of line 6—6 of FIG. 3.
FIG. 7 is a fragmentary longitudinal sectional view taken along line 7—7 of FIG. 2.
FIG. 8 is a fragmentary view of the tool showing the socket of the combination tool in section and in use driving a threaded fastener into a workpiece.
FIG. 9 is a fragmentary view of the tool showing the socket of the combination tool in section and as the head of the fastener device has been driven and drawn from the socket.
FIG. 10 is a fragmentary sectional view, similar to FIG. 9, of an alternate embodiment of the nose portion of the combination tool.

Turning first to FIG. 1, the composite, combination tool 10 is shown in operative association with a power tool device 12. This device 12 may typically be a hand held electric motor type device used to produce a rotary output to a drill or a nut running attachment.

The detailed construction of the combination tool 10 can best be seen in FIGS. 2 and 3 showing respectively the tool in position for use as a drill and in position for use as a socket wrench for driving a threaded fastener. It will be seen that the tool 10 is basically a composite, readily handled device consisting primarily of a mandrel stem 14 telescopically mounted in the bore of a body member 16 with a protective sleeve member 18 mounted for free rotation thereabount.

The mandrel will include a first extremity adapted to removably secure a drill bit 20 thereto. For this purpose, a set screw 22 is provided in the lower regions of the mandrel to nonrotatively secure the drill bit therein, as shown clearly in FIG. 7. The second, upper extremity of the mandrel will include surfaces, such as the hex configuration 24, adapted to transmit torque from the power tool 12 to the combination tool 10.

The body member 16 will be generally cylindrical and will include a bore extending axially completely through the body to receive the mandrel. A longitudinally extending elongated slot 26 is provided in the body and will be of a width substantially equal to the diameter of the set screw 22 which extends a light distance radially from the peripheral surface of the mandrel, for a purpose to be described later herein. A first or lower extremity of this body and bore will include a socket wrenching surface 28 which is adapted to receive and drive a rotary threaded fastener.

Thus, it will be apparent that when the mandrel 14 is in a retracted position as shown in FIG. 3 the drill is inoperative and the tool 10 will function as a socket wrench device.

Particular attention is directed to the FIGS. 3, 8 and 9 which illustrate an important feature of the invention. The lower or workpiece contacting extremity of the tool 10 will include an axially extending cavity or recess 30 with the inner periphery formed of nonrotation inducing surfaces. This recess will be of a depth substantially equal to the height of the head of a threaded fastener device, such as fastener 32, having a head 34. In operation, the head will be received in the rotation inducing socket cavity 28 with a washer base 36 serving as a stop to limit the entry of the fastener in the bore of the body. As the fastener is driven in a somewhat conventional fashion, the recess 30 will space the socket driving surfaces 28 above the workpiece surface 38 a distance substantially equal to the head of the fastener so that the fastener cannot be driven or torqued after the head of the fastener seats against the workpiece surface. The fastener 32 will be drawn out of the socket by the axial advancement of the fastener into the work surface until the head is in nonrotative inducing recess 30 when the fastener reaches the depth shown in FIG. 8 so that it will seat and contact work surface 38 without overdriving in the position shown in FIG. 9. The invention has been found to be particularly valuable for driving threaded fasteners into a hole drilled in concrete 39 where threaded fasteners may tend to strip threads formed therein under excessive torque. The nosepiece portion 40, including the socket surfaces and the recess, may be removably secured to the body by the use of a threaded connection 42 to enable the size of the socket to be varied.

For operator's safety and convenience, the sleeve 18, which is preferably of a thermoplastic material, is rotatively mounted over the body member and preferably extends the entire length of the body. The sleeve is retained from free axial movement relative to the body by a series of cooperating shoulders formed on the inner periphery of the sleeve and on the outer periphery of the body. A first or lowermost region 44 of the sleeve is provided with a stop portion 46 which is a somewhat limited axial extend of increased wall thickness. The upper and lower edges of this stop portion form shoulders coacting against shoulders formed on the body. An upper shoulder 48 and a lower shoulder 50 on the body define an annular recess 52 which receives the stop portion 46. These coacting shoulders serve to prevent free axial movement of the sleeve relative to the body but permit free rotation of the sleeve relative to the body, thus allowing a workman to grasp the sleeve, holding it stationary, while the tool rotates within it. The removable nosepiece element 40 facilitates the mounting of the sleeve on the body since the top edge of the nosepiece forms the lowermost shoulder 50 when the nosepiece is properly threaded on the body. The nose portion 44 of the sleeve is preferably of an outer diameter not substantially greater than the outer diameter of the body in that region to permit the tool to operate in confined areas. An intermediate portion 54 of the sleeve may be of a greater diameter and of a substantially greater wall thickness to provide a rugged structure which is quite often required in certain environments. The uppermost region of this intermediate portion 54 will terminate in the form of a shoulder 56 which is designed to abut a shoulder 58 formed in the uppermost region of the body. The upper region of the body may thereby be of a somewhat greater diameter than the lower region of the body. The top portion of the sleeve will be of a substantially less wall thickness than the remainder of the sleeve and of an outer diameter preferably the same as the diameter of the intermediate portion. This thin walled section 60 is thus readily compressible allowing an underlying spring 62 to be manipulated merely by depressing the wall of the sleeve in that region. A hole 64 is formed in the nose region of the sleeve to facilitate access to the set screw 22 when the drill is extended. This allows the drill bit to be removed without removing the sleeve.

The tool 10 can be easily transformed from a drilling tool to a wrenching tool by a simple push-pull operation. The mandrel 14 is releasably retained in a retracted position as shown in FIG. 3 by the spring 62 which is mounted at the rear of the body. The spring is attached at one of its ends 66 to the body and biased outwardly and spaced from the body by a bow portion 68. The free extremity 70 of the spring extends across the end of the body and is provided with an aperture 72 through which the mandrel is received. An annular groove 74 is formed in the mandrel at a position sufficient to retain the drill in the retracted position shown in FIG. 3. Since the spring is biased outwardly, the edge of the aperture will snap into the groove most clearly shown in the FIG. 6, thus retaining the mandrel from free axial movement in either direction. A circumferential portion of the aperture, such as segment 76, may be formed with a radius susbstantially equal to the radius of the slot to increase the abutting contact between the spring and the slot. When the tool is required to be used as a drill, a simple depression of the thin walled sleeve in the vicinity of the spring forces the spring to release engagement with the slot 74. A slight recess 78 may be formed at the extremity of the body to facilitate the depression of the spring. Once the spring has released its locking engagement with the slot, a simple pull upwardly of the body relative to the mandrel will extend the drill from the socket portion of the body as shown in FIG. 2. While the aperture of the spring of the need not interlock with a slot on the mandrel during the drilling operation, it should be noted that the bias of the spring will tend to exert sufficient frictional pressure on the mandrel to retain the body in the position shown in FIG. 2 from free movement under its own weight.

The set screw 22 holding the drill in the mandrel also serves to transmit torque from the power tool 12 to the wrenching socket means 28. The set screw will extend slightly beyond the periphery of the mandrel so as to be in torque transmitting interengagement with the sides of elongated slot 26. As will be seen in FIG. 7, the shoulder 80 on the mandrel will abut the shoulder 82 in the bore of the body to limit the extension of the drill through the body.

Turning to FIG. 10, an alternate embodiment of the nose section of the tool is shown wherein the sleeve portion may form the axial recess 30*a*. The use of a plastic material to nonrotatively abut the workpiece and still provide the recess for extracting the screw from the socket may be beneficial in certain environments where it is important to minimize the marring of the surface of a workpiece.

Referring now to FIGS. 11–14, another embodiment of the combination tool invention is shown which is capable of rapid change from the drilling to fastener setting mode. Tool 110, consistent with the structure of tool 10, includes a mandrel portion 114 reciprocally arranged within a substantially hollow body 116. The mandrel will have wrenching surfaces 124 at its upper extremity adapted to be associated with an appropriate power tool device. Longitudinally extending slot 126 in the body will include a hook-shaped extremity 127 at the upper region of the body. Torque will be transmitted from the mandrel to the body through a pin member 125 which is situated within the slot. Set screw 127 will retain the drill but will be substantially flush with the periphery of the mandrel and an access hole 121 may be provided in the body to facilitate changing of the drill bit 120. Rotatable sleeve 118 will function similarly to the sleeve 18 in the primary embodiment and includes abutment surface 146 cooperating with abutment surfaces 148 and 150 of the body and nosepiece, respectively, to axially retain the sleeve on the body. However, the sleeve 118 will be of limited axial extent confined to the region near the nosepiece 140.

Figure 11:
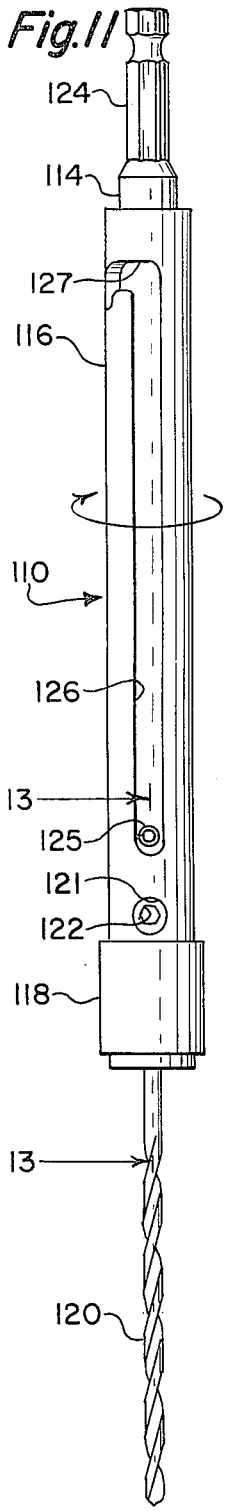
FIG. 11 is a side elevational view of a further embodiment of the combination tool shown in the drilling mode.
Figure 12:
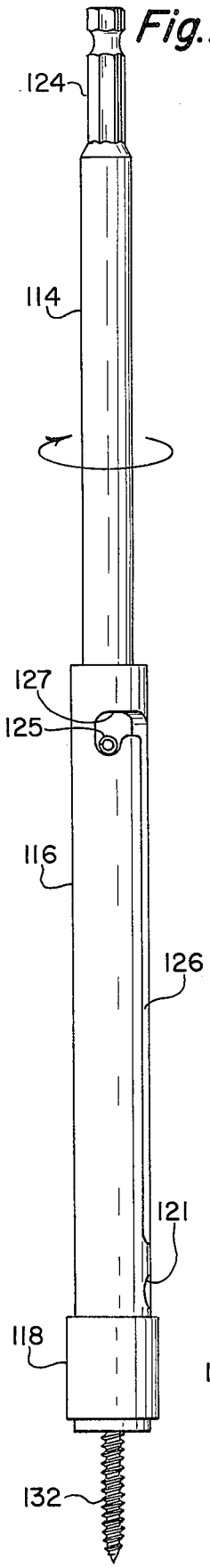
FIG. 12 is a side elevational view of the further embodiment of the combination tool in the fastener setting mode.
Figure 12:
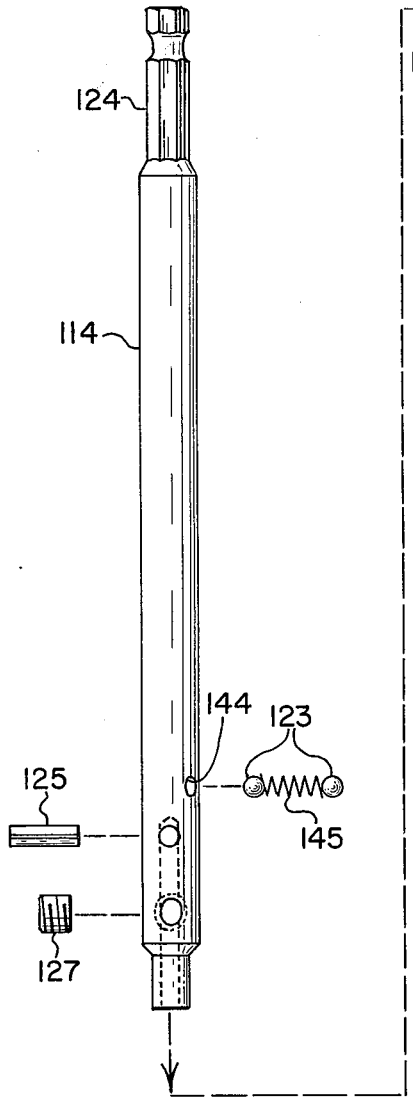
Figure 14:
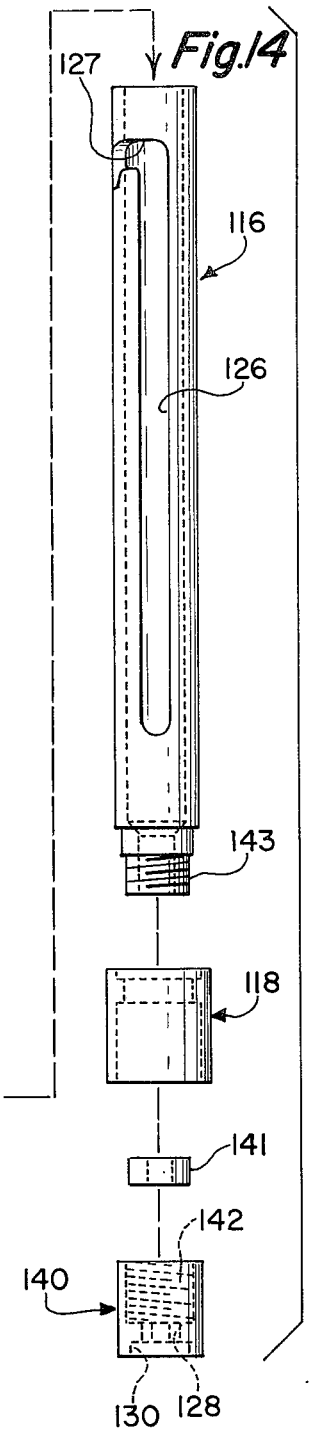
FIG. 14 is an exploded view of the embodiment of the combination tool shown in FIGS. 11–13.
Figure 13:
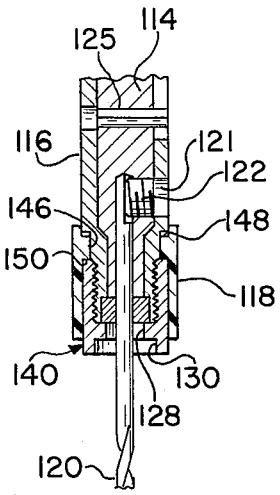
FIG. 13 is a partial longitudinal sectional view of the further embodiment of the tool taken along the lines 13—13 of FIG. 11.

In operation, the hole is first drilled in the workpiece with the tool in the drill extended configuration shown in FIG. 11. As the hole is completed, the hand tool is turned off and while the mandrel and sleeve are still rotating under their own inertia, the workman may grasp the small sleeve 118 and rapidly pull the body downwardly until the pin 125 reaches the top of the slot 126. Since the tool will still be rotating slightly, the pin 125 will tend to automatically seat itself in the hook-shaped portion of the slot in readiness for insertion of the fastener 132 in the socket 128. This substantially automatic tool changing and locking operation is facilitated by the placement of the hook-shaped slot extremity 127 to extend in the direction of rotation of the tool, as identified by the unmarked directional arrows in FIGS. 11 and 12.

In order to insure that the body member 116 is retained in the uppermost position on the mandrel during the drilling operation, a set of spring biased balls may be provided in an aperture in the mandrel. Balls 123 and srping 145 will serve to create an increased frictional drag between the body 116 and mandrel 114, which may be easily overcome due to the application of a slight force by the workman when the mode of operation is to be changed. The aperture 144 receiving the ball and spring device should not be located in line with the pin 125 in order to insure contact between the balls and the inner periphery of the body.

An annular magnet 141 may be positioned in the socket 140 immediately above the wrenching surfaces 128 to facilitate the temporary holding of the fastener 132 in the socket.

Thus it is apparent that there has been provided, in accordance with the invention, a combination tool that fully satisfies the objects, aims, and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

I claim:

1. A tool for drilling a hole in a workpiece and setting a screw-type fastener therein, including a rotatable mandrel with a first extremity including means to removably secure a drill bit in coaxial arrangement therewith and a second extremity having torque transmitting surfaces formed thereon, a generally cylindrical body having a through bore, the body thereby telescopically and axially slidably mounted on the mandrel, a sleeve member mounted on the body for rotation relative thereto, stop means interacting between the sleeve and the body preventing free axial movement of the sleeve relative to the body but permitting relative rotation therebetween, the body having first and second extremities respectively associated with the first and second extremities of the mandrel, the first extremity of the body including a wrenching socket means formed thereon, the second extremity of the body having spring means mounted thereon cooperating with groove means on the mandrel to selectively retain the mandrel in a retracted position relative to the body, axial recess means formed at the extremity of the tool associated with the first extremities of the body and mandrel, the recess means extending for a predetermined axial dimension from the terminal extremity of the wrenching socket means and having an internal transverse dimension greater than the transverse dimension of the wrenching socket means.

2. The tool in accordance with claim 1, wherein the sleeve member extends substantially the entire length of the body therefore serving to isolate the body from the user during the rotary operation of the tool.

3. The tool in accordance with claim 1, wherein the bore of the sleeve is provided with a pair of axially spaced shoulders in cooperative engagement with a pair of complementary axially spaced shoulders on the body thereby providing stop means to limit axial movement of the sleeve relative to the body.

4. The tool in accordance with claim 1, wherein the socket means includes means permitting selective detachment from the remainder of the body to permit interchangeability of size of sockets, a portion of the socket forming a shoulder cooperating with a shoulder formed in the bore of the sleeve to restrict downward movement of the sleeve on the body when the socket is attached to the body thereby providing for selective removal of the sleeve.

5. The tool in accordance with claim 1, wherein the spring means comprises a cantilever-type device with one end fixedly attached to the second extremity of the body and extending generally longitudinally of the body, the opposite free end of the cantilever-type device including an aperture extending transverse to the axis of the body across the second extremity of the body, the aperture being greater in at least one direction than the diameter of the mandrel in the region of the slot means, an intermediate segment of the device being bowed and biased outwardly from the body, the slot means formed at a predetermined position on the mandrel permitting an edge of the aperture to lockingly engage the mandrel selectively retaining it in a retracted position.

6. The tool in accordance with claim 5, wherein the surface of the body adjacent the spring is recessed permitting the spring to be compressed against the body to release the locking engagement between the spring and the mandrel.

7. The tool in accordance with claim 5, wherein the sleeve member is a plastic-type material and extends substantially the entire length of the body, the wall thickness of the sleeve being less in the region of the spring than in the other portions of the sleeve allowing the user to compress the wall of the sleeve in that region to activate the spring.

8. The tool in accordance with claim 1, wherein the body includes an elongate slot with a predetermined width exposing the mandrel for a predetermined axial extent of the body, a set screw forming means to secure a drill bit to the mandrel and extending radially outwardly from the mandrel when in a securing position, the set screw having a transverse dimension substantially equal to the width of the slot providing means to transmit torque from the mandrel to the body.

9. The tool in accordance with claim 1, wherein the axial recess means is formed integral with and as an extension of the socket means, the depth of the recess means being such as to be generally equal to the height of the head of an associated screw-type fastener thereby serving to prevent driving the fastener after the head has seated on the work surface.

10. The tool in accordance with claim 1, wherein the extremity of the sleeve associated with the first extremity of the body extends longitudinally beyond the wrenching socket means thereby forming the recess means, the depth of the recess means being such as to be generally equal to the height of the head of an associated screw-type fastener thereby serving to prevent driving the fastener after the head has seated on the work surface.

11. The tool in accordance with claim 1, wherein the sleeve has an aperture formed in the lowermost region thereof to permit access to the means for removably securing the drill bit.

12. A tool for drilling a hole in a workpiece and setting a screw-type fastener therein, including a rotatable mandrel with a first extremity including a drill bit in coaxial arrangement therewith and a second extremity having torque transmitting surfaces formed thereon, a generally cylindrical body having a through bore, the body thereby telescopically and axially slidably mounted on the mandrel, the body having first and second extremities, the first extremity of the body including a wrenching socket means formed therein, axial recess means formed at the first extremity of the body, the recess means extending for a predetermined axial dimension from the terminal extremity of the wrenching socket means and having an internal transverse dimension greater than the transverse dimension of the wrenching socket means wherein the wrenchgin socket means may be associated with the driving head of a screw-type fastener until the clamping surface of the head contacts the workpiece, the predetermined axial dimension of the recess means being substantially equal to the height of the head to prevent the application of rotary forces to the head after the head contacts the workpiece.

13. A tool in accordance with claim 12, wherein the cylindrical body and mandrel include means to selectively retain the body in predetermined telescopic relationship to the mandrel.

14. A tool in accordance with claim 12, including a sleeve member mounted on the body for rotation relative thereto.

15. The tool in accordance with claim 13, wherein the mandrel includes a radially extending pin member cooperating with a longitudinally extending slot in the body, the longitudinal slot including a hook-like configuration at its upper extremity to selectively retain the sleeve in one position relative to the mandrel.

16. The tool in accordance with claim 12, wherein a magnet is positioned above the wrenching socket to selectively retain a fastener head therein.

17. The tool in accordance with claim 14, wherein the sleeve extends for a limited axial extent on the body adjacent the first extremity thereof.

18. A tool for setting a screw-type fastener comprising a fastener head receiving nosepiece section including rotation inducing surfaces internal thereof and a recess extending axially of the nosepiece from the forward extremity thereof to the rotation inducing surfaces, the recess having an internal configuration adapted to be associated with the head of a fastener in a nonrotative inducing manner and including a minimum transverse dimension not less than the maximum transverse dimension of the rotation inducing surfaces, the recess having a predetermined axial dimension from the forward extremity thereof to the rotation inducing surfaces and being substantially equal to the height of the head of the screw-type fastener being driven, the rotation inducing surfaces and recess being fixed axially relative to each other wherein the screw-type fastener may be driven into a workpiece and be drawn out of contact with the rotation inducing surfaces as the head contacts the workpiece so as to automatically control and limit the setting torque to prevent overdriving the fastener.

19. The tool in accordance with claim 18, wherein the recess and torque transmitting surfaces are formed as a one-piece socket member.

20. The tool in accordance with claim 19, wherein the recess is generally circular in cross section and the rotation inducing surfaces are in the form of internal polygonal wrenching surfaces.

* * * * *